US008002095B2

(12) United States Patent
Godshaw et al.

(10) Patent No.: US 8,002,095 B2
(45) Date of Patent: Aug. 23, 2011

(54) BUCKLE AND ELASTIC LUGGAGE STRAP

(75) Inventors: Donald Godshaw, Wilmette, IL (US); Zoran Gracer, Deerfield, IL (US); Du Hai, Fujian Province (CN); Brad L. Schantz, Evanston, IL (US)

(73) Assignee: Travel Caddy, Inc., Elk Grove Village, IL (US)

( * ) Notice: Subject to any disclaimer, the term of this patent is extended or adjusted under 35 U.S.C. 154(b) by 419 days.

(21) Appl. No.: 12/337,693

(22) Filed: Dec. 18, 2008

(65) Prior Publication Data

US 2010/0155187 A1 Jun. 24, 2010

(51) Int. Cl.
*A45C 13/38* (2006.01)

(52) U.S. Cl. ..... 190/102; 190/108

(58) Field of Classification Search ..... 190/102, 190/108

See application file for complete search history.

(56) References Cited

U.S. PATENT DOCUMENTS

| | | | | |
|---|---|---|---|---|
| 2,581,417 | A * | 1/1952 | Cooley | |
| 4,108,342 | A * | 8/1978 | Riva | |
| 4,425,678 | A * | 1/1984 | Pepper | 452/187 |
| 4,591,183 | A * | 5/1986 | Gordon et al. | 280/655 |
| 4,727,987 | A | 3/1988 | Zezza | |
| 5,026,089 | A | 6/1991 | Grimmonpre | |
| 5,303,805 | A * | 4/1994 | Hauser | |
| 5,323,886 | A * | 6/1994 | Chen | |
| 5,429,288 | A | 7/1995 | Sattler | |
| 5,697,128 | A * | 12/1997 | Peregrine | |
| 5,699,886 | A * | 12/1997 | Latshaw | |
| 5,842,673 | A | 12/1998 | Fenton | |
| 5,890,571 | A * | 4/1999 | Sadow | |
| 5,927,450 | A * | 7/1999 | Sadow | |
| 5,988,334 | A | 11/1999 | Caruso | |
| 6,038,745 | A | 3/2000 | Rapp | |
| 6,141,841 | A | 11/2000 | Workman | |
| 6,359,203 | B1 | 3/2002 | Cronos | |
| 6,389,605 | B2 | 5/2002 | Srivastava | |
| 6,389,655 | B2 | 5/2002 | Libecco | |
| 6,449,815 | B1 | 9/2002 | Spiller | |

(Continued)

FOREIGN PATENT DOCUMENTS

BE 840057 A 7/1976

OTHER PUBLICATIONS www.swissarmy.com/travelgear, 22" Deluxe Expandable Wheeled Travel Bag, No. WT-22, Style No. 30300103, 2 pages, Dec. 4, 2008.

(Continued)

*Primary Examiner* — Tri M Mai

(74) *Attorney, Agent, or Firm* — Fitch Even Tabin & Flannery

(57) ABSTRACT

A luggage holder for holding a carrying case or valise stacked upon a wheeled case having a telescoping handle includes a pair of spaced elastic cords extending from a fastener plate attachable to the wheeled carrying case. A medial bridging element connects the cords and is slidably adjustable along the length of the cords to enhance the placement of appropriate retention forces on a case stacked upon the wheeled carrying case and positioned against a telescoping handle. An adjustable spacing plate is provided to fit over the telescoping handle and includes frictional material on one side to insure retention of the spacing plate and the assembly with the telescoping handle.

5 Claims, 5 Drawing Sheets

U.S. PATENT DOCUMENTS

| | | | | |
|---|---|---|---|---|
| 6,578,231 | B1 * | 6/2003 | Godshaw et al. | 16/114.1 |
| 6,666,363 | B2 | 12/2003 | Godshaw et al. | |
| 6,757,944 | B2 | 7/2004 | Buscart | |
| 6,772,485 | B2 | 8/2004 | Alpert | |
| 7,093,324 | B2 | 8/2006 | Udy | |
| 7,340,804 | B2 | 3/2008 | Saderholm et al. | |
| 7,343,648 | B2 | 3/2008 | Shaw | |
| 2006/0102672 | A1 | 5/2006 | Godshaw | |
| 2007/0084893 | A1 | 4/2007 | Godshaw et al. | |
| 2007/0215426 | A1 * | 9/2007 | Mincey | 190/115 |
| 2008/0042460 | A1 * | 2/2008 | Fuchs | 294/150 |
| 2008/0116028 | A1 | 5/2008 | Gold et al. | |
| 2008/0196988 | A1 | 8/2008 | Tong | |
| 2009/0095588 | A1 * | 4/2009 | Thomas | 190/102 |

OTHER PUBLICATIONS www.lugbuddy.com, LugBuddy, Blue Sky Products, LLC, 2 pages Dec. 4, 2008.

Piggy Back Suspender Strap, The Ballistic Travel Bag Collection, Jul. 1, 1995, 2 Pages.

* cited by examiner

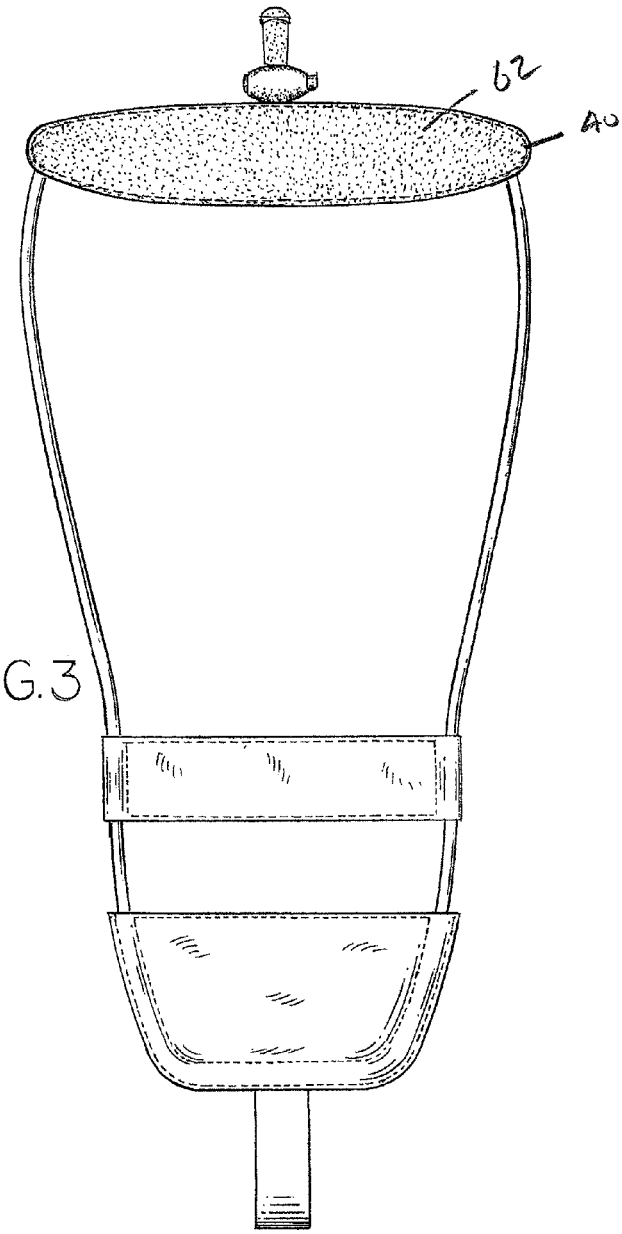
FIG.3
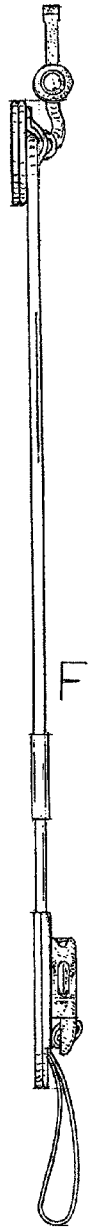
FIG.5
FIG.7
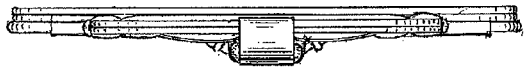

BUCKLE AND ELASTIC LUGGAGE STRAP

BACKGROUND OF THE INVENTION

In a principal aspect the present invention relates to a luggage holder for maintaining a valise or carrying case stacked upon a wheeled case or luggage item of the type having a telescoping handle extendable from one side thereof. The luggage holder is comprised of spaced elastic straps which are joined together to form an adjustable length loop that may be attached to the wheeled case and then positioned over the carrying case to be retained against the telescoping handle of the wheeled case.

Travelers often find it convenient to use a wheeled carrying case and in addition a valise, briefcase or carrying case for their computer, personal papers and additional luggage items. A traveler may thus somehow place and retain the carrying case on the top of the wheeled case by attaching in some manner the carrying case in position against the telescoping handle of the wheeled case. Various devices have been proposed to effect the attachment and maintenance of the carrying case in position on a wheeled carrying case. By way of example and not limitation, a product known as the "lug buddy" is commercially available for such a purpose.

While such a device is convenient, it has limitations. The degree of adjustability is limited. Their ability to retain an item satisfactorily in place upon the wheeled luggage, and in particular, in position lodged against the telescoping handle of wheeled luggage, is limited often causing the carrying case to slip or become disengaged from its perch or position on a wheeled carrying case.

Thus, there has developed a need for an improved luggage holder of the general type for holding a carrying case or valise stacked upon a wheeled case of the type having a telescoping handle. It is to be noted that a wheeled case having a telescoping handle typically includes a carry handle on the top side of the wheeled case as well as a telescoping handle which is typically designed to telescope from one of the lateral sides of the wheeled carrying case. The luggage holder of the present invention is designed for utilization with such an arrangement in a wheeled case, although it has applicability to various other designs and other utilitarian purposes with respect to binding or holding travel cases and luggage in combination.

SUMMARY OF THE INVENTION

Briefly, the present invention comprises a luggage holder for holding a carrying case stacked upon a wheeled case of the type having a top side with a carry handle and a lateral side with a telescoping handle. The telescoping handle may be projected upwardly above the top side of the wheeled case. The luggage holder of the invention includes spaced elastic cords projecting or extending from a fastener plate. The fastener plate includes a buckle with a strap which may be attached to the top side handle of the wheeled carrying case. The elastic cords which project from the fastener plate slidably extend and pass through a bridging element connected between the elastic cords. The elastic cords further project upwardly from the bridging element and are connected to a cord spacing plate. The ends of the cords are connected by means of an adjustable connector or clamping element. The upper spacing plate may include a frictional material on one surface to facilitate maintaining the upper end fitted over the telescoping handle of the wheeled case. The bridging element which connects the elastic cords intermediate the fastener plate and the spacing plate may be slidably adjusted between the plate to maximize the ability of the luggage holder to hold a carrying case stacked upon the wheeled case and against the telescoping handles.

Thus, it is an object of the invention to provide an improved luggage holder for holding a carrying case upon a wheeled case of the type having a telescoping handle.

A further object of the invention is to provide a luggage holder which is designed to maintain a carrying case by providing a force spread against the side of the carrying case to hold the case in position against the telescoping handles of the wheeled carrying case.

Another object of the invention is to provide a luggage holder which includes a bridging element which is adjustable to facilitate the maintenance of forces or pressure to hold a carrying case supported on a wheeled case.

Further, it is an object of the invention to provide a luggage holder which is adjustable to provide for variable holding forces upon a carrying case stacked upon a wheeled case.

Another object of the invention is to provide a luggage holder which has a myriad of uses for the stacking of luggage items and which is highly adjustable.

These and other objects, advantages and features of the invention will be set forth in the detailed description which follows.

BRIEF DESCRIPTION OF THE DRAWING

In the detailed description which follows, reference will be made to the drawing comprised of the following figures:

FIG. 3 is a reverse side plan view of the view of the embodiment of FIG. 2;

FIG. 5 is a left hand side view of the embodiment of FIG. 2;

FIG. 7 is a bottom plan view of the embodiment of FIG. 2;

DESCRIPTION OF AN EMBODIMENT OF THE INVENTION

Figure 1:
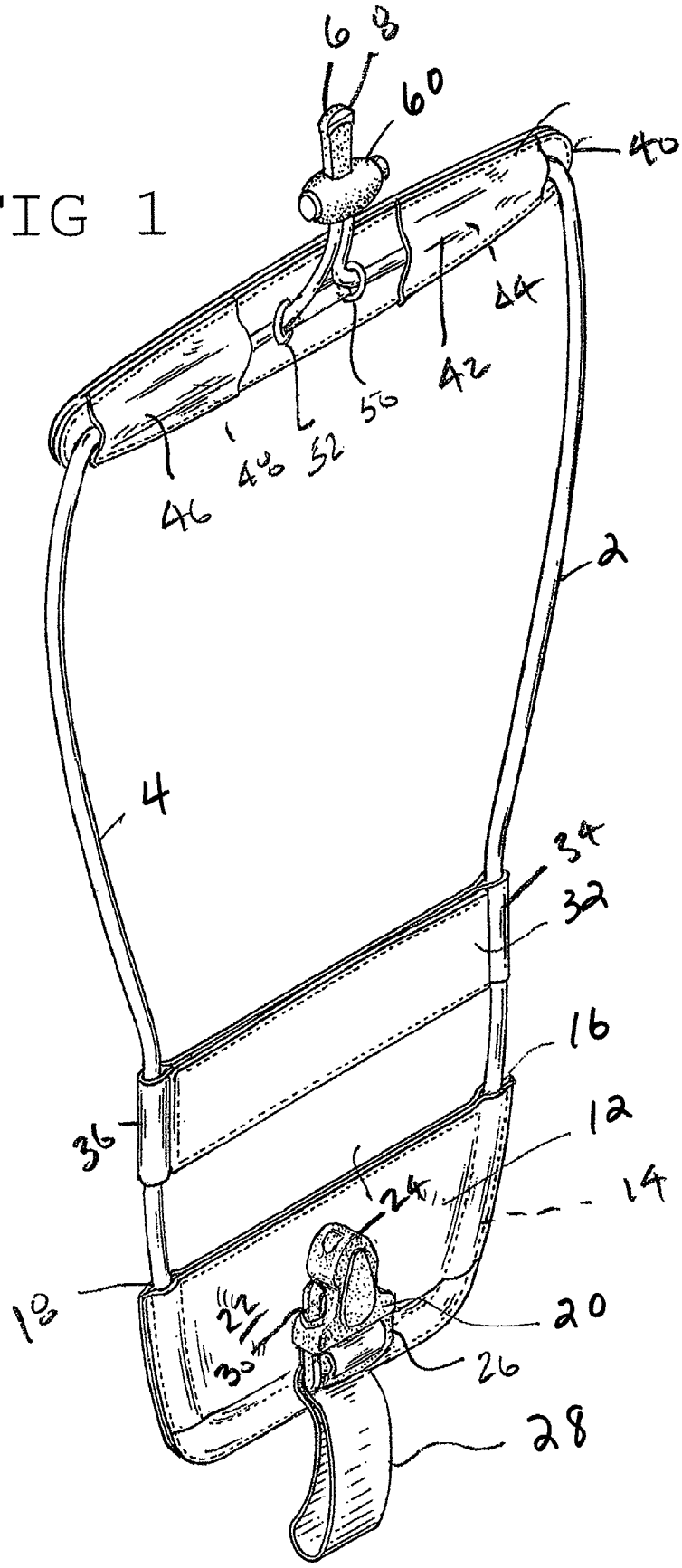
FIG. 1 is an isometric view of an embodiment of the invention.
Figure 6:
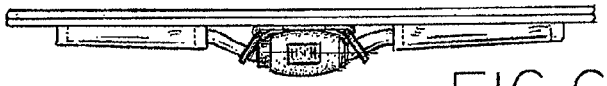
FIG. 6 is a top plan view of the embodiment of FIG. 2.
Figure 2:
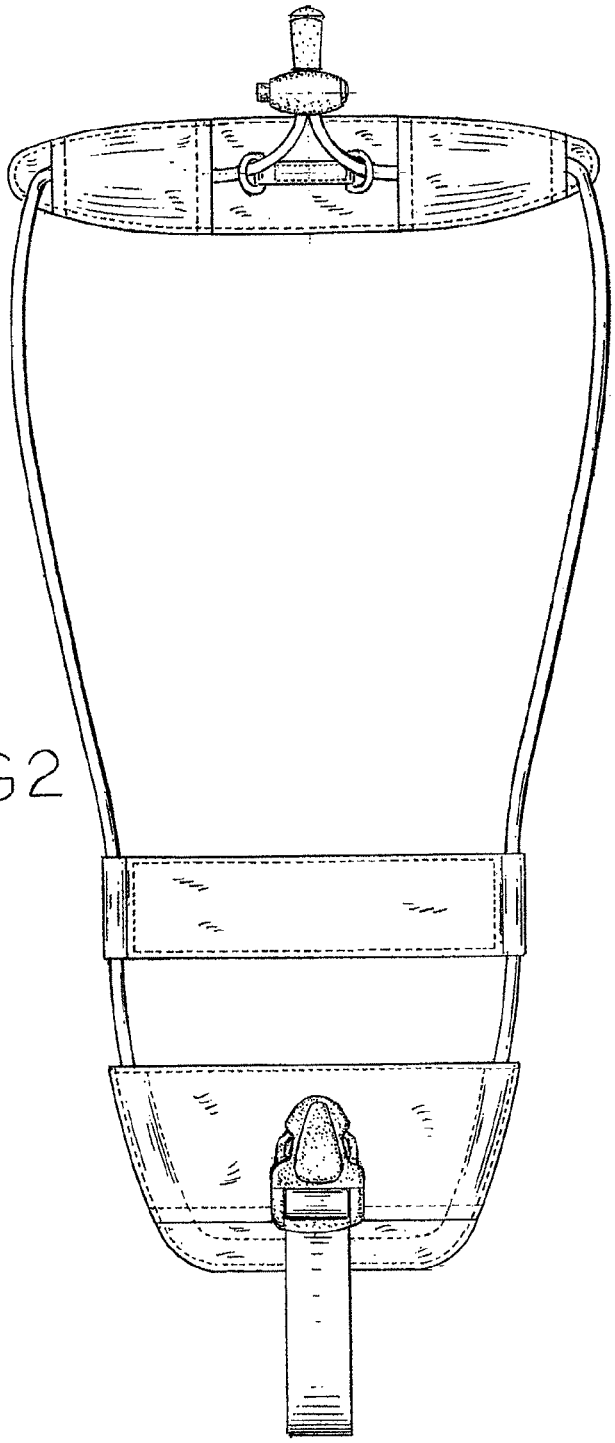
FIG. 2 is a plan view of the embodiment of FIG. 1.
Figure 4:
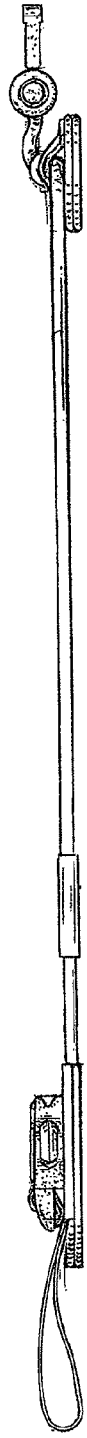
FIG. 4 is a right hand side view of the embodiment of FIG. 2.
Figure 9:
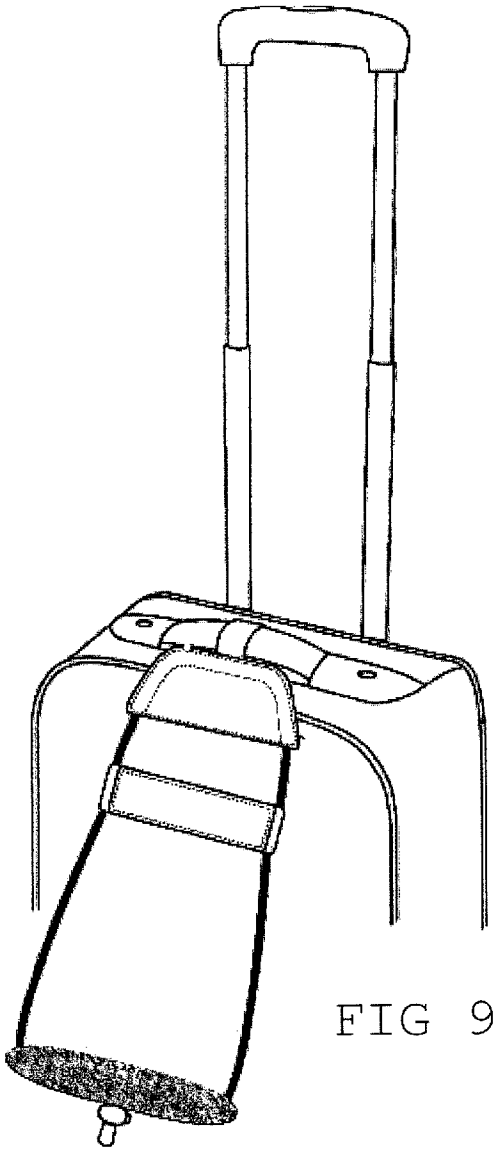
FIG. 9 is an isometric view illustrating the attachment of the luggage holder of the invention to a wheeled carrying case having a telescoping handle.

Referring to FIGS. 1-7, there is illustrated an embodiment of the invention. The luggage holder of the invention is comprised of a first elongate, elastic cord 2 and a second elongate elastic cord 4. In the embodiment depicted, the first cord 2 and the second cord 4 comprise a single, unitary elastic cord having opposite terminal ends 6 and 8 which pass through and are joined side by side by means of an adjustable connector or clamp element 10. Thus, the elastic cords 2 and 4, as depicted, are designed to form a complete, closed loop.

The elastic cords 2 and 4 are retained in spaced relationship at their lower end by a fastener plate 12. The fastener plate 12 includes a stitched passage 14 which defines a pathway for the cords 2 and 4. Typically, the cords 2 and 4 are sewn into position so that their extent from exit passages 16 and 18 of the fastener plate 12 provide an equal length of cord 2 and 4. However, the cords 2 and 4 may be sewn into the fastener plate 12 and not be slidable through the passage 14.

The fastener plate 12 is fabricated from a material which has an adequate stiffness to maintain the spacing of the cords 2 and 4. A stiffening member, for example, may be incorporated between two layers of fabric forming the fastener plate 12 to maintain adequate separation of the cords 2 and 4. The cords 2 and 4 are preferably separated a distance of 2 to 10 inches. The fastener plate 12 has a vertical height in the range of 2 to 6 inches.

A buckle construction 20 is affixed to the outside face 22 of the fastener plate 12. The buckle construction 20 is comprised of a buckle retention element 24 and a releasable element 26. An adjustable length strap 28 is fitted through the releasable element 26. The releasable element 26 may be detached from the fixed element 24 by engaging release buttons 30.

An important feature of the invention is the inclusion of a slidable bridging element 32. The bridging element 32 is comprised of a material which is adequately stiff to maintain separation of the cords 2 and 4. The bridging element 32 thus may be a reinforced fabric material or a pair of fabric layers which include a stiffening element therebetween. The opposite sides of the bridging element 32 define first and second slide passages 34 and 36 through which the cords 2 and 4 are slidable. The bridging element 32 thus may be adjusted longitudinally along the length of the spaced elastic cords 2 and 4.

The elastic cords 2 and 4 connect to a spacing plate 40. The spacing plate 40 is comprised of a generally stiff, rigid or semi-rigid material or assembly adequate to maintain the spacing of the terminus ends of the cords 2 and 4. Thus, the spacing plate 40 may be comprised of a leather material or reinforced fabric materials. The spacing plate 40 includes a first outer cover or sheet of material 42 along one lateral side forming a passage 44 for the terminus end of the elastic cord 2. In similar fashion, the opposite side of the spacing plate 40 includes a cover 46 which defines a passage 48 for the terminus end of the cord 4. Circular clips 50 and 52 receive the terminus ends of the cords 2 and 4, respectively. The terminus ends 6 and 8 of the cords 2 and 4 then fit through and are maintained tightly joined or retained by the adjustable connector or clamp element 60. Thus, the cords 2 and 4 may be adjusted in length and the spacing plate 40 may also be adjusted along the length of the elastic cords 2 and 4.

The depiction of the device in FIG. 1 is thus considered the front side of the luggage holder. FIG. 3 illustrates the backside. There it will be noted that the spacing plate 40 includes a frictional material 62 covering the backside surface 41. The spacing of the cords 2 and 4 effected by the spacing plate 40 is such that the spacing will typically exceed the spacing of the telescoping elements and the handle of a telescoping handle of a wheeled item of luggage.

Figure 8:
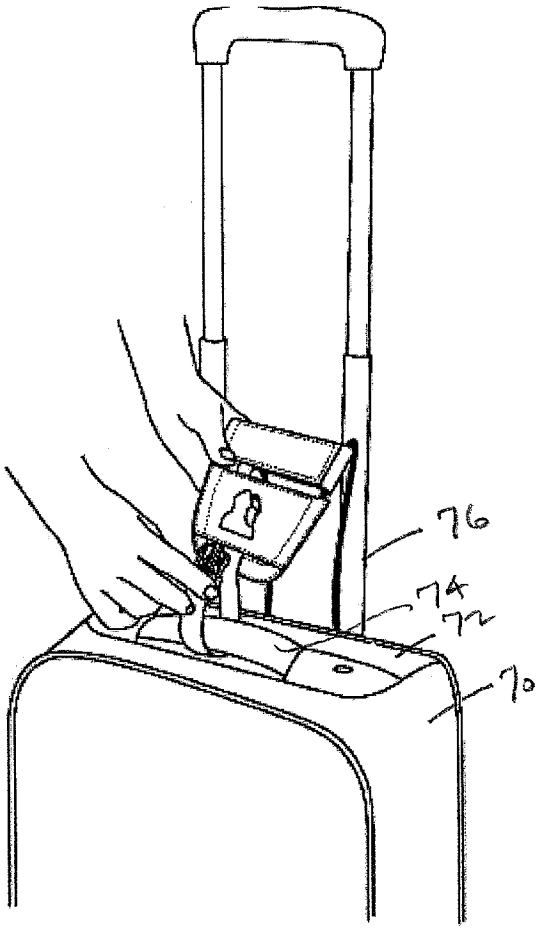
FIG. 8 is an isometric view illustrating the manor of use of the luggage holder of the invention.

FIGS. 8-11 illustrate the manner of use of the luggage holder of the invention. Referring to those figures, a typical wheeled case 70 includes a top side 72 having a handle 74 with a telescoping handle arrangement 76 attached to a lateral side of the wheeled luggage 70. As a first step in the use of the luggage holder of the invention, the release element 26 of the buckle construction 20 is released from the attached element 24. The length of the strap 28 is adjusted and the strap 28 is fitted through the opening defined by the handle 74. The releasable element 26 is then affixed to the attached element 24 mounted on the fastener plate 12 as depicted in FIG. 8. The result is attachment of the holder to the position shown in FIG. 9.

Figure 11:
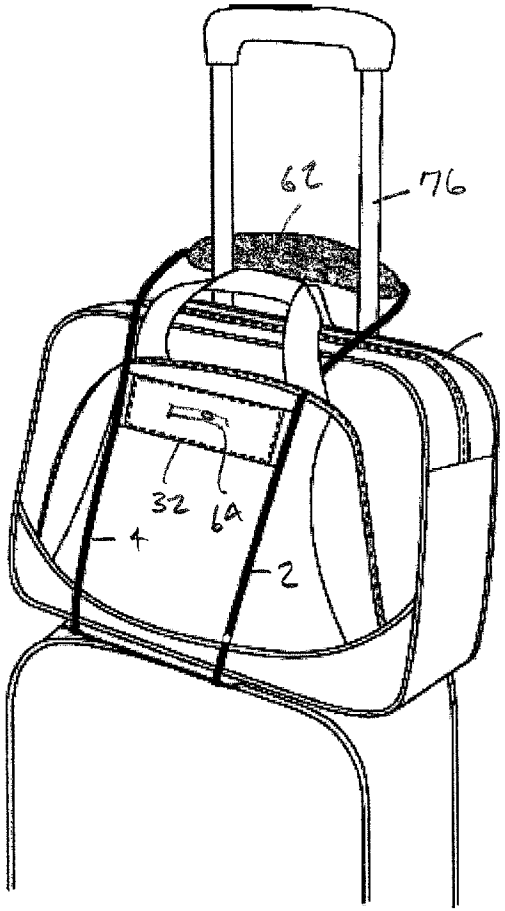
FIG. 11 is an isometric view of the luggage holder of the invention illustrated as retaining a carrying case supported on a wheeled case having a telescoping handle.
Figure 10:
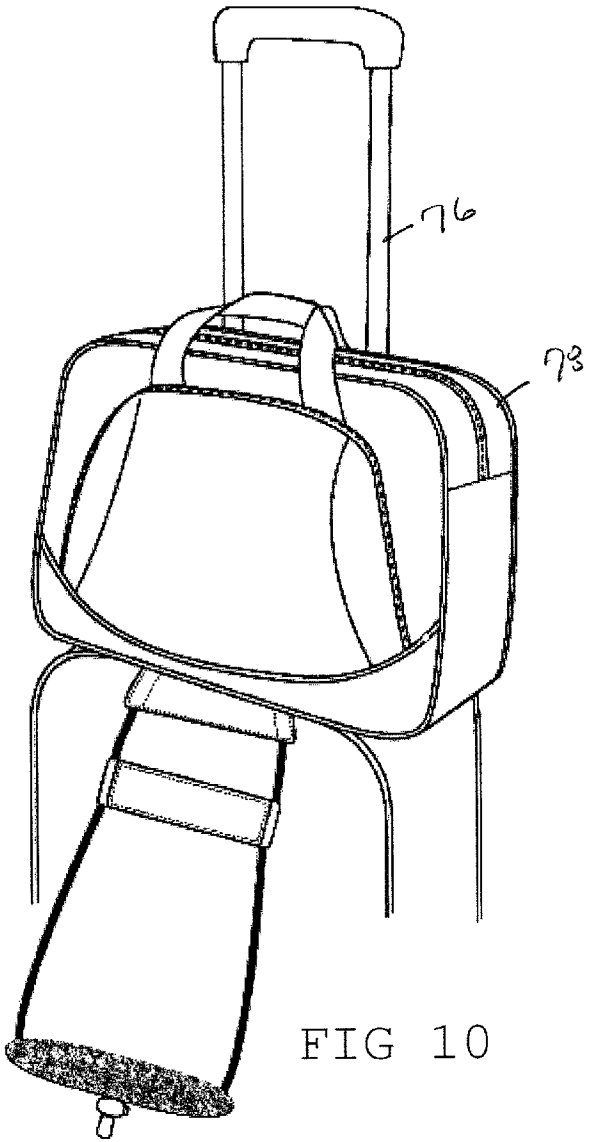
FIG. 10 is an isometric view of the use of the luggage holder of the invention.

Thereafter, an auxiliary case, valise or the like 78 is placed on the top side 72 of the wheeled luggage item and rested against the telescoping handle 76. This is depicted in FIG. 10. Subsequently, the cords 2 and 4 are stretched and the bridging element 32 is adjusted along the length of the cords 2 and 4 so that it will appropriately and rigidly maintain a force to hold the case 78 in place as shown in FIG. 11. Of course, the effective length of the cords 2 and 4 may be altered by virtue of the clamp element 10 being appropriately adjusted to provide elastic forces to maintain the component parts under tension. Additionally, it will be noted that the frictional surface 62 is positioned against the handles of the telescoping handle 76 to further retain the assembly in a stable condition. As an additional feature of the invention, the bridging element 32 may be adjustable from side to side or between the cords 2 and 4 to thereby adjust the spacing of the cords 2 and 4. Thus, an adjustable detent mechanism 64 may be included as an element of the strap 32.

Various other modifications may be made without departing from the spirit and scope of the invention. That is, the materials used to make the various plates and web members may be varied. The types of buckles and the elastic cord arrangement may be varied. The adjustability of the cords and the stability created by the bridging element and plate elements described enable a higher degree of confidence that the case 78 will be supported appropriately on the case 70. Thus, while there has been set forth a preferred embodiment of the invention, it is to be understood that the invention is limited only by the following claims and equivalents thereof.

What is claimed is:

1. A luggage holder for holding a carrying case stacked upon a wheeled case having a side with a handle and a telescoping handle, said holder comprising:

a first elastic cord;

a second elastic cord;

a fastener plate, said first and second cords joined to the fastener plate and extending therefrom;

a buckle on the fastener plate for attachment to a handle of a wheeled carrying case adjacent a telescoping handle of said wheeled carrying case;

a bridge element defining spaced, generally parallel first and second spaced passages for slidably receiving the first and second elastic cords respectively extending from the fastener plate, said first and second cords extending from said first and second passages; and an adjustable connection element for adjustably connecting the first and second elastic cords extending from the bridge element, whereby the buckle may be fastened to the handle of the wheeled case and the elastic cords and bridge element may be fitted over said case stacked on the wheeled case, and the first and second cords may also be fitted over the telescoping handle of the wheeled case to retain the case supported on the wheeled case against the telescoping handle.

2. The holder of claim 1 further including a spacing plate for slidably receiving the first and second cords from the bridge element.

3. The holder of claim 1 wherein the first and second cords comprise a single cord forming a loop through the fastener plate, said fastener plate including first and second spaced exit passages for the first and second cords spaced substantially the distance of said first and second passages of the bridge element.

4. The holder of claim 1 wherein the fastener plate includes a strap member with said buckle mounted thereon, said buckle including a first separable buckle element connectable to a second buckle element mounted to said fastener plate.

5. The holder of claim 4 wherein said strap member is adjustably attached to the first buckle element.

* * * * *